United States Patent [19]

Wright

[11] 4,059,203

[45] Nov. 22, 1977

[54] DISPENSING OF LABELS

[75] Inventor: Maurice J. Wright, Rutland, England

[73] Assignee: Norprint Limited, Boston, England

[21] Appl. No.: 686,532

[22] Filed: May 14, 1976

[30] Foreign Application Priority Data

May 15, 1975 United Kingdom ..... 20525/75

[51] Int. Cl.[2] ..... B65H 5/28

[52] U.S. Cl. ..... 221/73; 221/1; 156/542; 226/88; 271/188

[58] Field of Search ..... 221/69–74, 221/1; 156/584, 541, 542; 226/88, 168, 196; 271/188, 209, 8; 312/91

[56] References Cited

U.S. PATENT DOCUMENTS

| | | | |
|---|---|---|---|
| 1,617,560 | 2/1927 | Aldrich et al. | 226/168 |
| 2,317,576 | 4/1943 | Avery | 156/541 |
| 2,341,368 | 2/1944 | Flood | 221/73 |
| 3,283,886 | 11/1966 | Addis et al. | 221/70 |
| 3,393,849 | 7/1968 | Hass | 226/196 |

FOREIGN PATENT DOCUMENTS

| | | | |
|---|---|---|---|
| 2,027,377 | 12/1970 | Germany | 221/73 |

*Primary Examiner*—Robert B. Reeves
*Assistant Examiner*—H. Grant Skaggs
*Attorney, Agent, or Firm*—Leydig, Voit, Osann, Mayer & Holt, Ltd.

[57] ABSTRACT

A dispense edge member for detaching a pressure-sensitive label from a backing strip is shaped to impart a transverse curvature to the label during detachment from the backing strip. The curvature increases the rigidity of the label and prevents drooping of the label.

13 Claims, 13 Drawing Figures

DISPENSING OF LABELS

BACKGROUND OF THE INVENTION

1. Field of the Invention

This invention relates to the dispensing of labels from a strip incorporating a supply of labels.

2. Description of the Prior Art

It is well known that strips of silicone-treated backing paper are used to carry a continuous series of discrete self-adhesive labels, and that such labels are detached adjacent the point of application by passage over a dispense edge member at which the backing paper is drawn sharply away from a label as the label is about to be dispensed. The label is then applied to an article to be labelled by a roller or a pad, or, in certain instances, by the application of suction to the label followed by a blowing action impelling the label on to an article to be labelled.

Hitherto, such dispense edge members have included a rectilinear edge extending transversely to the path of the backing strip and, at the instant when a label becomes completely detached from the backing strip, the label is, ideally, plane.

The facility of detaching a label from the backing strip depends to a large extent on the comparatively higher stiffness of the label in comparison with the stiffness of the silicone-treated paper backing strip but nevertheless there is a risk, in practice, that the label will "droop" once it has become partially detached and such droop can result in the label becoming bent about a transverse band line and then mis-applied by the application member.

SUMMARY OF THE INVENTION

According to one aspect of the present invention, there is provided a method of dispensing a pressure-sensitive label carried by a backing strip such that the label can be peeled from the strip, wherein the strip is passed over a dispense edge to remove the strip from said label, and the label is curved transversely to the direction of dispense during removal of the strip.

According to another aspect of the invention, there is provided a device for detaching a pressure-sensitive label from a backing strip, said device comprising means locatable in the path of the strip to deflect the strip whereby to cause the strip to be drawn away from the label, said means being so shaped as to impart a curvature to the label transversely to the direction of detachment, and the shape of said means being such that the path length of the strip in the direction of passage over said means is substantially the same across the whole width of the strip.

According to yet another aspect of the invention, there is provided a method of forming a dispense edge member, wherein a sheet metal blank is folded into two parts interconnected by a curved fold which forms the leading edge portion of the member, and one of said parts and the adjacent portion of the fold are shaped, by a pressing operation, to define a concave depression having its axis directed transversely of the leading edge portion.

BRIEF DESCRIPTION OF THE DRAWINGS

Embodiments of the invention will now be described, by way of example only, with reference to the accompanying diagrammatic drawings, in which.

DESCRIPTION OF THE PREFERRED EMBODIMENTS

Figure 1:
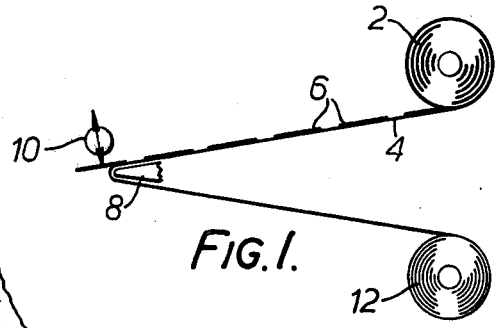
FIG. 1 is a schematic side elevation of a label applicator including a dispense edge member in accordance with the invention.

The label applicator shown in FIG. 1 comprises a reel 2 containing a roll of backing strip 4 carrying a series of self-adhesive labels 6 which have a greater rigidity than that of the strip 4. The backing strip 4 is silicone-treated or is otherwise such as to permit the labels to be peeled from the strip 4. The strip 4 passes around a dispense edge member 8 the leading edge portion **8*a* of which defines a dispense edge located in the path of the strip and which causes the individual labels 6 to be detached from the strip 4 by abruptly deflecting the strip 4 away from the labels 6. The labels 6, when detached, are applied to an article by a roller 10 or any other suitable means, and the strip 4 free of labels is wound on a reel 12**.

Figure 2:
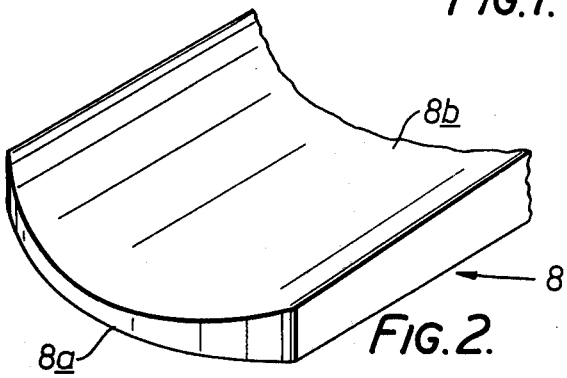
FIG. 2 is a perspective view of a dispense edge member in accordance with the invention.

Referring to FIG. 2, the leading edge portion **8*a* of the dispense edge member 8 is convex as viewed in plan, and the upper surface 8*b* of the member 8 is concave. For convenience the lower surface of the member 8 is plane. With this arrangement the label will be given a curved or bowed form in cross-section transversely to the direction of dispensing movement with the concavity facing upwardly so that any tendency to droop is resisted because the rigidity is increased longitudinally of the label by virtue of its curved or bowed form. The convex form of the leading edge portion 8*a* of the member 8 causes stripping or peeling of each label 6 to commence at the center of the edge portion 8*a* and to progress outwardly in both senses. It will be noted from FIG. 2, that due to the concave form of the upper surface 8*b*, the thickness of the member 8 increases progressively from its longitudinal central portion towards each of its lateral edges. This increasing thickness is compensated for by the curvature of the leading edge portion 8*a* so that the overall path length of the backing strip 4 along the member 8 is substantially constant across the whole width of the strip 4, thus obviating the formation of differential stresses across the width of the strip 4**.

As the detachment of the label 6 from the backing strip 4, progresses along the length of the label only a decreasing portion will be progressively held on the backing strip and ultimately the applying roller 10 or other applying means will take over control of the partially detached label 6 before the detachment is completed.

As will be apparent, by means of the dispense edge member described, it will be possible to improve, substantially, the accuracy with which a label can be applied to an article whether by hand or by a machine. Stray air currents will have less effect and, as in the case of a belt pulley which is cambered, the path of the strip will be more exactly defined along the center-line.

Figure 3:
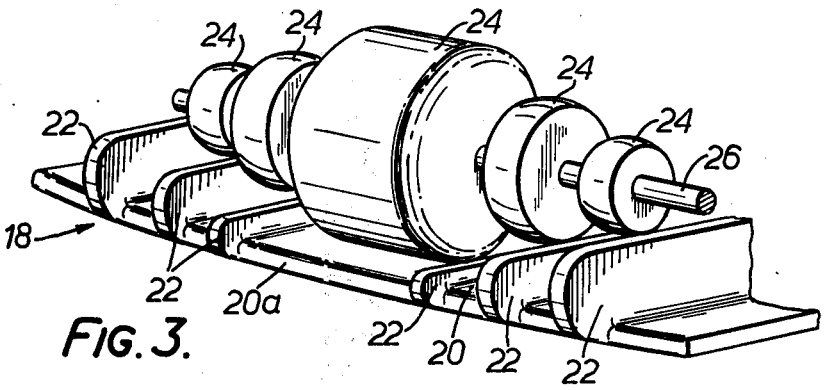
FIGS. 3 to 7 are perspective views of further forms of the dispense edge member.

In the embodiment of FIG. 3 the dispense edge member 18 is defined by a plane support member 20 having a leading edge portion 20*a* which is convex when viewed in plan, with upstanding longitudinal ribs 22. To assist in bowing the labels about to be dispensed, pressing means in the form of rollers 24 of varying sizes are arranged so that each one lies opposite one of the grooves defined by adjacent ribs but the rollers do not extend into the grooves. All the rollers 24 rotate about the same axis 26. As will be apparent, the ribs 22 are of different heights with the shallowest ribs nearest the center-line of the member 20; the terminal curvatures of the ribs 22 differ correspondingly. The ribs 22 define a concave surface having a similar effect to that provided by the surface 8*b* of FIG. 2. The rollers 24 may be replaced by corresponding downwardly extending ribs.

Figure 4:
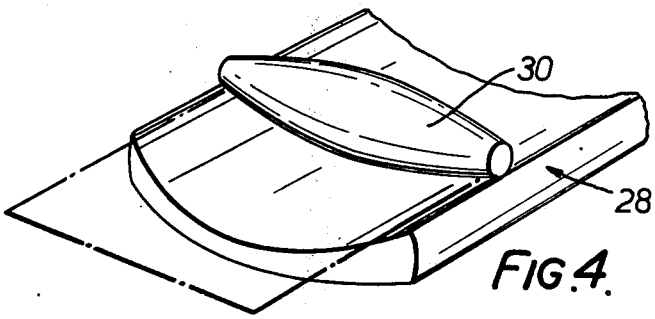

The dispense edge member 28 of FIG. 4 is generally similar to that of FIG. 2, but a single transverse pressing roller 30 is provided having a curvature complementary to the upper surface of the dispense edge member 28. As in the previous embodiments this roller assists in imposing a bowed form on the labels.

Figure 5:
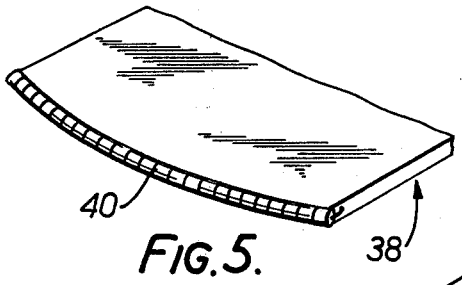

The dispense edge member 38 of FIG. 5 has a leading edge portion defined by a series of beads or small rollers 40. The upper surface is plane, but the lower surface of the member has a form similar to the upper surfaces of the previous embodiments. In this embodiment, the dispense edge member is used in a label applicator in which a backing strip having labels on its under-surface passes along the lower surface of the member and then along the upper surface, whereby the labels will be dispensed with their adhesive surfaces uppermost.

Figure 6:
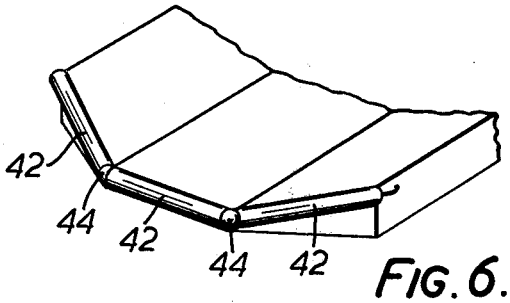

In FIG. 6, the small rollers 40 of FIG. 5 are replaced by three longer rollers 42 and two circular beads 44 nested in adjacent end cavities of the longer rollers. The beads 42 may be retained by wire. The edge member is thickened below to ensure a constant length path over the whole width of the backing strip.

Figure 7:
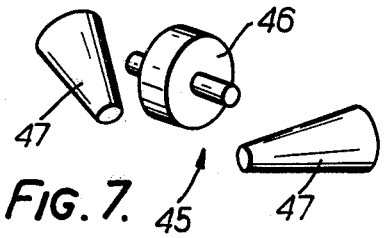

The dispense edge member 45 shown in FIG. 7 comprises a central roller 46 and two outer rollers 47 of frusto-conical form or of generally frusto-conical form but with a convex curvature. The roller 46 acts in conjunction with the rollers 47 to impart a bowed form to the labels being dispensed, and the shape of the rollers 47 ensures that the strip follows substantially the same path length around the rollers 47 at all positions across its width.

Figure 8:
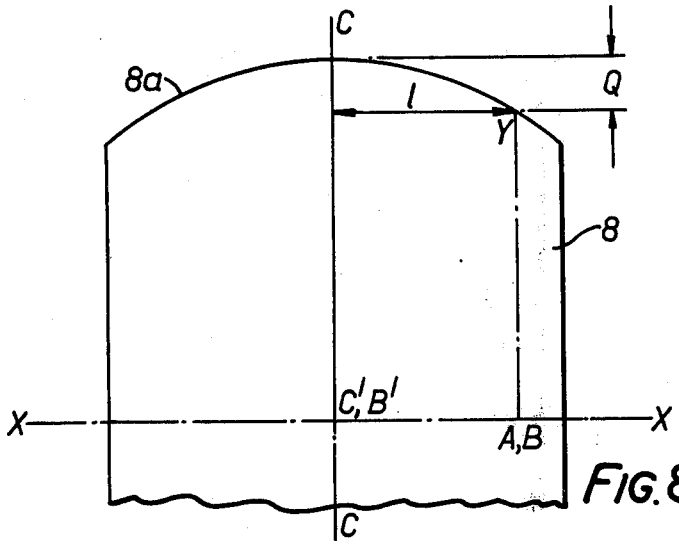
FIG. 8 is a schematic plan view of a dispense edge member in accordance with the invention with the shape of the member being exaggerated for explanatory purposes.
Figure 9:
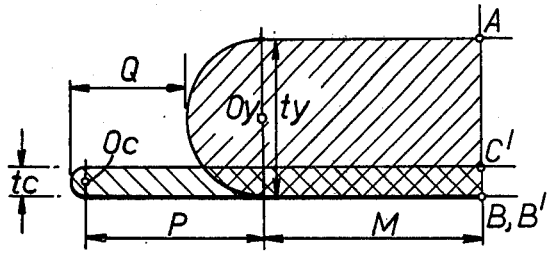
FIG. 9 is a side elevation of the member shown in FIG. 8 and indicating the curvature of the member at two different locations.
Figure 10:
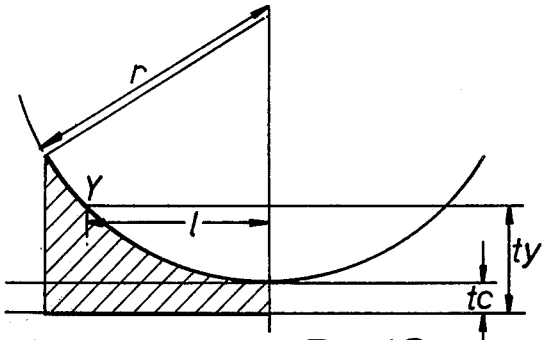
FIG. 10 is a transverse cross-section of the member shown in FIGS. 8 and 9.

The calculations involved in constructing a dispense edge member in accordance with the invention will now be set out with particular reference to FIGS. 8 to 10 which relate to the dispense edge member of FIG. 2 and schematically show the member in plan, in longitudinal section at two positions across the width of the member, and in transverse section.

Assuming a circular curvature of radius $r$ for the upper surface 8*b* of the dispense edge member, and that the thickness of the member at its longitudinal central plane is $t_C$, then the thickness $t_Y$ at any point Y on the curved surface 8*b* at a distance $l$ from the longitudinal central plane C—C of the member is determined by the following equation:

$$t_Y = r + t_C - \sqrt{r^2 - l^2} \qquad \text{EQN.I}$$

The leading edge portion 8*a* of the member is assumed to be of semi-circular section (as viewed in FIG. 9) at the centerline and at any point on either side of the centerline. In order to avoid differential stresses arising across the width of the backing strip as it passes over the member, it is required that any path traced along the surface of the member parallel to the central plane C—C, and starting from a transverse line on the upper surface of the member, and passing around the leading edge portion of the member and along the lower surface of the member to a transverse line vertically beneath the starting line, shall be of the same length irrespective of its distance from the plane C—C.

Taking a section (FIG. 9) through point Y a path can be traced from a point A on a transverse line X—X on the upper surface of the member, around the semi-circular leading edge portion and along the lower surface of the member to a point B on a transverse line aligned with the line X—X.

This path length (AB) is given by the following equation:

$$AB = 2M + \pi/2\, t_Y \qquad \text{EQN.II}$$

Where M is the distance between the line X—X and the center of curvature $O_Y$ of the semi-circular section of the leading edge portion 8*a* at the point Y.

Similarly, taking a section through the plane C—C we have a path $$C'B' = 2M + 2P + \pi/2\, t_C \qquad \text{EQN.III}$$

Where P is the distance between a transverse line passing through the center of curvature $O_Y$ at the point Y, and the center of curvature $O_C$ of the semi-circular section of the leading edge portion at the plane C—C.

Since it is required that $AB = C'B'$, by combining equations I, II and III it follows that $$P = \pi/4\,(r - \sqrt{r^2 - l^2}) \qquad \text{EQN.IV}$$

The distance by which the leading edge portion 8*a* of the member 8 at the center is in advance of that at any point Y determines the curvature of the leading edge portion in plan and is designed Q in FIGS. 8 and 9.

$$Q = P + (t_C/2) - (t_Y/2) \qquad \text{EQN.V}$$

Substituting EQN.IV in EQN.V.

$$Q = (\pi/4 - \tfrac{1}{2})\,(r - \sqrt{r^2 - l^2}) \qquad \text{EQN. VI}$$

Taking a pratical example of a 65 mm. wide dispense edge member with a minimum central thickness ($t_C$) of 1.5 mm. and a maximum depth of 10 mm. at each side, the radius $r$ will equal 66.382 mm. From EQN.VI we can plot Q for $r$ = 66.382 and various values of $l$ between 0 and 65/2 mm. as shown in Table I below:

TABLE I

| l (mm) | Q (mm) |
|---|---|
| 1 | 0.002 |

TABLE I-continued

| l (mm) | Q (mm) |
|---|---|
| 5 | 0.054 |
| 10 | 0.216 |
| 15 | 0.490 |
| 20 | 0.880 |
| 25 | 1.395 |
| 30 | 2.045 |
| 32.5 | 2.426 |

In the above equations I and VI, the shape of the leading edge portion of the member is calculated from the criterion that the concave surface of the member is of circular cross-section.

Alternatively, the leading edge portion of the member can be of part-circular form when viewed in a direction normal to the direction of movement of the strip, and the curvature of the concave surface of the member can be calculated from this criterion so that the path length of the backing strip is substantially constant across the entire width of the strip.

Figure 11:
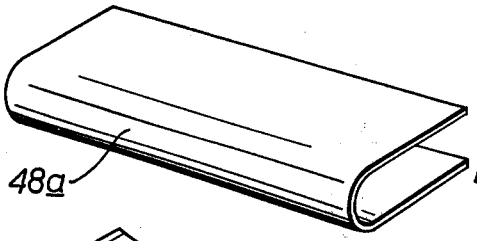
FIG. 11 is a perspective view showing a first stage in the manufacture of a dispense edge member from a sheet metal blank.
Figure 13:
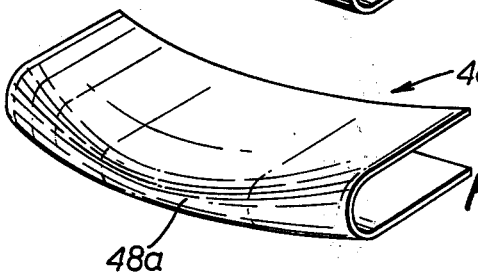
FIG. 13 is a perspective view showing the finished member.
Figure 12:
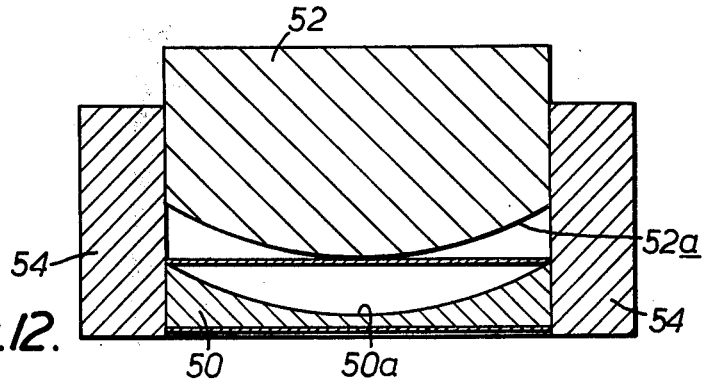
FIG. 12 is a transverse section showing a second stage in the manufacture of the member from the blank.

There is shown schematically in FIGS. 11 to 13 a method of manufacturing from sheet metal, a dispense edge member 48 dimensioned according to the criteria discussed in relation to FIGS. 8 to 10. As shown in FIG. 11 a sheet of metal is folded in two with a curved fold 48*a* which forms the leading edge portion of the member, the radius of curvature of the fold 48*a* being substantially equal to the required radius at the lateral edges of the leading edge portion of the member.

The folded metal sheet is then located in a press tool comprising a female die 50 (FIG. 12) located between the two layers of the sheet and having a part-cylindrical surface 50*a* with a radius of curvature corresponding to the required radius *r* of the upper surface of the member, with appropriate allowance being made for the thickness of the sheet. The upper surface of the sheet is then pressed into the die 50 by a male press member 52 having a part-cylindrical surface 52*a* with a radius of curvature corresponding to the required radius *r*. The folded sheet is confined laterally during pressing by lateral blocks 54; the curved fold 48*a* is, however, unconfined during pressing to enable it to bulge and adopt the correct curvature. The completed dispense edge member is shown in FIG. 13. The outer surface of the member preferably has a P.T.F.E. layer which is applied, prior to shaping the metal sheet, either in the form of a self-adhesive layer, or as a coating. The P.T.F.E. layer acts as a lubricant during shaping of the metal sheet, and also provides a low-friction surface for the backing strip 4 when the member is in use.

In each of the dispense edge members described above, peeling is progressive from a point and a curvature is imparted to a label being dispensed to stiffen the label whereby droop of the label is obviated. The absence of such droop allows the trailing edge of a label being dispensed to be detected at a point very close to the dispense edge so that a substantial proportion of the label will have been dispensed, but retained rigidly at the instant of detection. This enables far more accurate positioning of labels than is possible if the label is sensed well upstream of the dispense edge.

I claim:

1. A method of dispensing a pressure-sensitive adhesive label carried by a backing strip such that the label can be peeled from the strip, said strip having a central portion and lateral portions at each side of the central portion, said method comprising providing a dispense edge having a central portion in contact with the central portion of the strip, and lateral portions in contact with the lateral portions of the strip, with the central portion of the edge being located in front on the lateral portions of the edge, passing a strip over the dispense edge to peel the strip from a said label with peeling commencing at the central portion, providing the label and strip with a curvature transversely to the direction of dispense during peeling of the strip, and providing the curved strip with a constant path length across its width during passage of the strip over the dispense edge.

2. A method according to claim 1, wherein the curvature is imparted to the label and strip by a concave portion of the dispense edge.

3. A device for detaching a pressure-sensitive adhesive label from a backing strip having a central portion and lateral portions at each side of the central portion, said device comprising means defining a dispense edge located in the path of the strip to deflect the strip whereby to cause the strip to be drawn away from the label, said edge having a central portion in contact with the central portion of the strip and lateral portions in contact with the lateral portions of the strip, the central portion of the edge being located in front of the lateral portions of the edge, said edge being so shaped as to impart, prior to and during peeling of the strip, a curvature to the label and strip transversely to the direction of detachment, and the shape of said edge being such that the path length of the curved strip in the direction of passage over said edge is substantially the same across the whole width of the strip.

4. A device according to claim 3, further comprising a dispense edge member located in the path of the strip and having means providing a surface which is of concave section transversely to the direction of movement of the strip across the member, said surface terminating in a leading edge portion extending across the width of said surface, said leading edge portion defining said dispense edge.

5. A device according to claim 4, wherein the leading edge portion has an arcuate profile defining the central portion and the lateral portions of the dispense edge.

6. A device according to claim 4, wherein the leading edge portion is of arcuate form in longitudinal section.

7. A device according to claim 4, wherein said surface is defined by a series of parallel ribs of varying depths, said ribs extending parallel to the direction of movement of the strip.

8. A device according to claim 4, further comprising means for pressing the strip into engagement with the said concave surface.

9. A device according to claim 4, wherein the said member is formed from sheet metal blank folded along one dimension to provide two parts interconnected by the fold, said fold forming the leading edge portion, and one of said parts being formed with a longitudinal, partially-cylindrical, depression which defines the concave surface.

10. A label applicator for applying pressure-sensitive adhesive labels from a backing strip carrying a series of such labels, said applicator comprising means defining a dispense edge located in the path of the strip, said edge being of convex form when viewed in a direction normal to the surface of the strip upstream of the edge, said edge being curved concavely when viewed along the path of the strip to impart to each label and the strip, prior to and during peeling of the strip, a curved section transversely to the direction of dispensing and said edge being of varying thickness so that the curvature of the edge is compensated for the backing strip whereby the strip traverses the same length path over said edge across the whole width of the strip.

11. A dispense edge member for dispensing pressure-sensitive adhesive labels from a silicone-treated backing strip, said member having opposed surfaces contacted by the strip and a leading edge portion connecting said surfaces and operative to deflect abruptly the strip, said leading edge portion being of convex form when viewed in a direction normal to said surfaces and said member having a varying thickness across its width such that the path of travel of the backing strip over the edge member is substantially constant across the width of the strip, and the labels and strip are given a curvature transversely to the direction of dispense prior to and during peeling of the strip.

12. A dispense edge member according to claim 11, wherein the member is formed from a sheet metal blank folded into two parts interconnected by a curved fold which forms the leading edge portion of the member, and one of said parts and the adjacent portion of the fold are shaped, by a pressing operation, to define a concave depression having its axis directed transversely of the leading edge portion.

13. A dispense edge member according to claim 12, wherein the depression is of part-cylindrical form and the leading edge portion is unconfined during pressing.

* * * * *